US008127953B2

(12) United States Patent
Vert

(10) Patent No.: US 8,127,953 B2
(45) Date of Patent: Mar. 6, 2012

(54) REFILL BOTTLE COMPRISING A CONTAINER, THE CONTAINER HAVING A BOTTLE AND A CAP

(75) Inventor: Gilles Vert, Aurillac (FR)

(73) Assignee: Qualipac, Neuilly sur Seine (FR)

( * ) Notice: Subject to any disclaimer, the term of this patent is extended or adjusted under 35 U.S.C. 154(b) by 728 days.

(21) Appl. No.: 12/301,023

(22) PCT Filed: May 16, 2007

(86) PCT No.: PCT/FR2007/000837

§ 371 (c)(1),
(2), (4) Date: Nov. 15, 2008

(87) PCT Pub. No.: WO2007/132100

PCT Pub. Date: Nov. 22, 2007

(65) Prior Publication Data

US 2009/0120893 A1 May 14, 2009

(30) Foreign Application Priority Data

May 17, 2006 (FR) ..... 06 04409

(51) Int. Cl.
*B65D 1/04* (2006.01)

(52) U.S. Cl. ..... 215/12.1; 215/6; 215/273; 206/466

(58) Field of Classification Search ..... 215/12.1, 215/6, 273; 220/592; 62/457.4, 371; 222/48, 222/105

See application file for complete search history.

(56) References Cited

U.S. PATENT DOCUMENTS

| | | | | |
|---|---|---|---|---|
| 3,080,989 | A * | 3/1963 | Ramsbotham | 215/12.1 |
| 4,370,989 | A * | 2/1983 | Taylor | 132/317 |
| 4,371,087 | A * | 2/1983 | Saujet | 215/12.1 |
| 4,836,416 | A * | 6/1989 | Shalgi et al. | 222/48 |
| 6,305,580 | B1 * | 10/2001 | Chen | 222/162 |
| 2010/0282762 | A1 * | 11/2010 | Leonard | 220/592.01 |

OTHER PUBLICATIONS

International Search Report dated Dec. 3, 2007.

* cited by examiner

*Primary Examiner* — Anthony Stashick
*Assistant Examiner* — Cynthia Collado
(74) *Attorney, Agent, or Firm* — Perman & Green, LLP

(57) ABSTRACT

A refill bottle that includes a refill and an enclosure having a body and a cap engaging through an attachment device. The cap has three parts, an external cap with an enveloping skirt, an internal cap provided with a locking mechanism, and an actuation ring able to move about the spout of the refill. The attachment device includes a fixed hook on the body and a pivoting hook on the internal cap, the pivoting hook being disposed on a lever of the first type that pivots about a hinge integrated in the molding, and the actuation ring acts by rotation of the end of the lever opposite to the hook. Application to cosmetics bottles.

10 Claims, 1 Drawing Sheet

REFILL BOTTLE COMPRISING A CONTAINER, THE CONTAINER HAVING A BOTTLE AND A CAP

CROSS REFERENCE TO RELATED APPLICATIONS

This application is the National Stage of International Application No. PCT/FR2007/000837 International Filing Date, 16 May 2007, which designated the United States of America, and which International Application was published under PCT Article 21 (2) as WO Publication No. WO2007/132100 and which claims priority from French Application No. 0604409, filed on 17 May 2006, the disclosures of which are incorporated herein by reference in their entireties.

BACKGROUND

1. Field

This disclosed embodiments concern a refill bottle in which a refill containing a consumable fluid product can be replaced in a container for a refill bottle.

2. Brief Description of Related Developments

Refill bottles are used in two main areas of application: the use of a fluid contained in a bottle requires a costly mechanism and the bottle container itself is costly. As such, a "refill" is used to permit reusing the costly part for technical and/or esthetic reasons.

For the refill, in the form of a bottle, to be inserted into the container and removed from it, it must be possible to open the container in one way or another.

As such, one has refill bottle containers that include at the end opposite to the spout, a simple plug that closes the container.

In other refill bottles, for instance as described in document U.S. Pat. No. 4,370,989, the refill is secured to cap, and a container bottle is secured to the cap around the refill. This separation of the container into a bottle and a cap presents a problem of engagement between the bottle and the cap, for this engagement to be reliable, sturdy, simple and cheap.

SUMMARY

The disclosed embodiments involve the problem of engagement of the bottle and the cap of the container of such a refill bottle. In particular, it concerns the locking and unlocking control mechanism for engaging the bottle and the cap, through the implementation of an activation ring arranged around the bottle spout.

The disclosed embodiments permit the solution of the aforementioned problem through the embodiment of a three-part cap, an essentially esthetic external cap, an internal cap comprising the essentials of the mechanism and an activation ring of which an activation part is situated around the spout of the bottle and the operating part is hidden by the internal and external caps.

More specifically, the disclosed embodiments concern a refill bottle, comprising a refill bottle and a container with the container comprising a bottle and a cap engaging through an attachment device; according to the disclosed embodiments, the cap comprises three parts, an external cap with an enclosing or wrap-around skirt, an internal cap with a locking mechanism, and a mobile activation ring around the spout of the bottle; the attachment device comprises at least a fixed hook on the body and a pivoting hook of the internal cap, with the pivoting hook being located on the lever of the first type that pivots around a hinge on the internal cap, and the activation ring acts by rotation on the end of the level opposite to the hook. The hinge is preferably formed of a hinged integrated in the molding.

Preferably, the bottle consists of two attachment devices that have opposite positions.

In a beneficial embodiment, the internal cap has at least a projection or ledge in a plane perpendicular to the centerline of the spout and the hinge integrated in the molding is formed onto the projection or ledge so that it has a radial dimension greater than the thickness of the internal cap.

Preferably, the activation ring has a rest position in which the attachment device is engaged, and an activation position in which the hooks of the attachment device as separated.

Preferably, the activation ring comprises for each lever, a radial finger that extends beyond its base for the purpose of moving the end of the lever opposite to it that carries the hook in the unlocking position.

Preferably, the activation ring includes a second radial finger that extends beyond its base for the purpose of maintaining the end of the end of the lever opposite to the one that carries the hook in the locking position so that the two hooks cannot be separated.

Preferably, the activation ring includes a blocking protrusion that is to fit inside a cavity of the internal cap when the activation ring is in the rest position.

Preferably, the cavity of the internal cap is delimited by an elastic component capable of flexing to let the blocking protrusion pass when the latter is subjected to a moving force by rotation of the activation ring.

Preferably, the three parts of the cap are kept engaged so that the internal cap and the external cap cannot be separated.

Other features and advantages of the disclosed embodiments will be better understood when reading the description that follows with an example of embodiment, referenced against the attached drawings on which:

Figure 1:
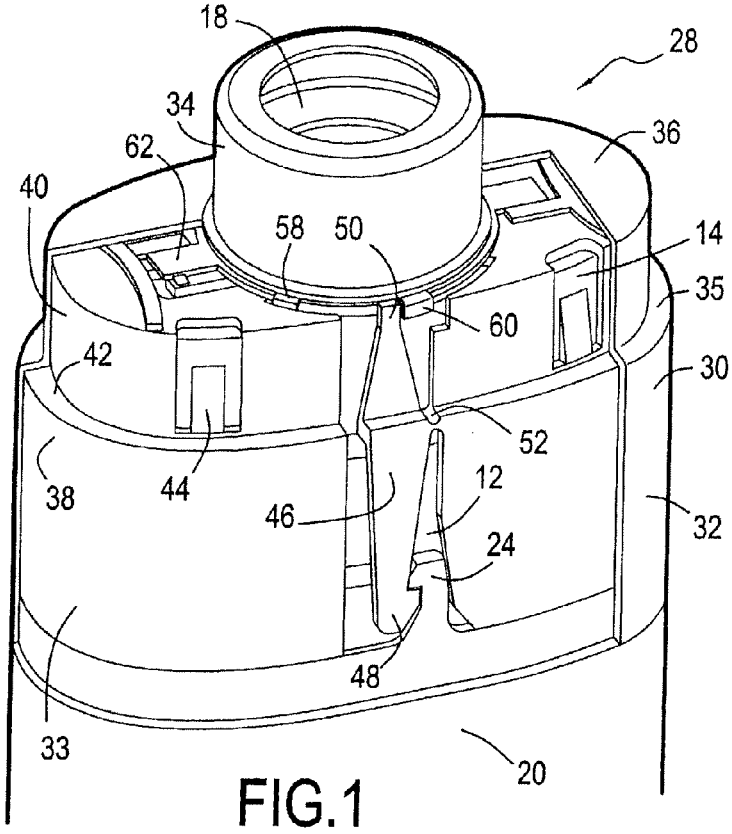
FIGS. 1 and 2 represent, with a part of the external cap removed, the top part of a refill bottle container according to the disclosed embodiments, in the rest and activation positions respectively.

The bottle according to the disclosed embodiments includes a refill 10 that has the form of a flask or bottle and a container.

Refill 10 includes essentially a cylindrical body 12 with a considerably oval cross-section, of which the top part has an analogous cross-section extension but smaller, with the two sections 12 and 14 being connected by a projection or ledge 16. The top part of refill 10 has a spout 18.

DETAILED DESCRIPTION

Figure 3:
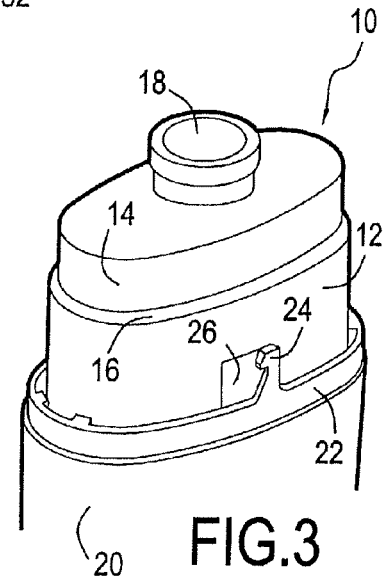
FIG. 3 represents a refill bottle located in the container body, with the cap removed.

The container includes a body 20 and a cap 28. As is clearly shown by FIG. 3 on which the cap is not shown, body 20 of the container has an extension side 22 for the purpose of engaging with a skirt of the cap, and on each side, a hook 24 of an attachment device of the cap on the body. For the mechanical resistance of the hook 24 to be increased, a side 26 is associated with it and it has a smaller thickness than that of the hook.

Cap 28 includes three parts: an external cap 30, an internal cap 33 and an activation ring 34.

External cap 30 includes an enclosing or wrap-around skirt 32 for the purpose of surrounding side 22 of body 20. This skirt 32 is connected by a project or ledge 35 to a top part 36 that delimits a circular hole for letting activation ring 34 pass through.

The internal cap 33 and the activation ring 34 constitute the essential parts for the locking and unlocking mechanism of the attachment device that permits the cap and the container body to engage.

Internal cap 33 has a bottom skirt 38 and a top section 40 that are linked by a projection or ledge 42 corresponding to projection or ledge 35 of the outside cap and to projection or ledge 16 of refill 10. Openings delimiting elastic fingers 44 are formed in top section 40 so that these elastic fingers 44 attach to the top edge of top section 14 of the refill. This form of securing the internal cap onto the bottle is just one possibility and is not indispensable for operation.

Internal cap 33 includes on each side a lever 46 for which the bottom end carries a hook 48 for the purpose of engaging with hook 24 of the container body. The two hooks 24, 48 represent the attachment device of the cap onto the container body.

Lever 46 is of the first type, in other words, that point of application of the activation force is located at end 50 of lever 46 that is opposite to the end of the hook, with the hinge 52 being situated between extremities 48, 50. Beneficially, this hinge is a integrated hinge obtained by molding.

Even though it is possible to embody a lever like 46 in an internal cap that has a continuous skirt in the two sections 38 and 40, it is preferable that hinge 52 is located at an projection or ledge 42, because it can be thin and wide and as such can guide lever 46 during its pivoting in a reliable fashion.

Figure 2:
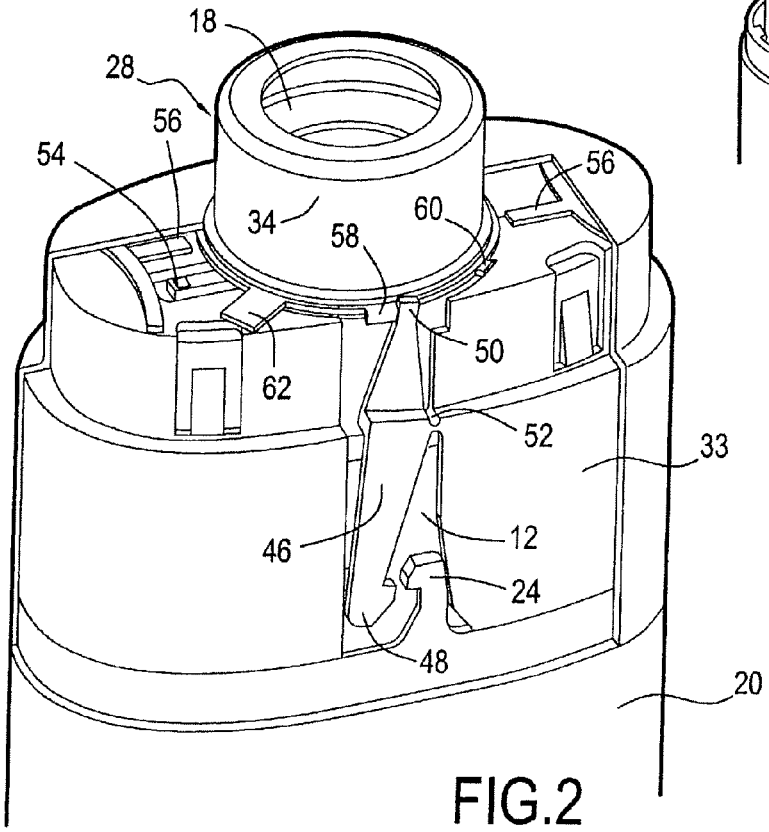

As shown by FIG. 2, the top surface of internal cap 33 includes an elastic finger 54 and a stop 56 that delimit among themselves a holding cavity for which the purpose is described below.

The activation ring 34 includes at its bottom periphery, an activation finger 58 of lever 46. On FIG. 1, this finger is located under the top surface of the internal cap. FIG. 2 indicates that finger 58 acts on extremity 50 of the lever, so that hook 48 of the lever can be separated from hook 24 of the body and permit the removal of the cap with respect to the body. This finger 58 represents as such an unlocking device of attachment device 24, 48.

FIG. 1 indicates that the base of activation ring 34 carries another finger 60 that, in the rest position of the activation ring shown on FIG. 1, is adjacent to extremity 50 of lever 46 and thus prevents this lever from pivoting. In other words, this second finger 60 represents a locking device of the attachment device 24, 48 preventing the separation of the cap and the container body.

Activation ring 34 is also equipped with a protrusion 62 that moves between the internal cap 33 and top part 36 of external cap 32. This protrusion, in the rest position, is maintained between elastic finger 54 and stop 56. A user must exert a certain force by elastic finger 54 to turn activation ring 34.

Use of the refill according to the disclosed embodiments is very simple. When a user wishes to replace a refill 10, he turns the activation ring 34 by an angle of about 35 degrees counterclockwise. Cap 28 and body 20 of the container can then be easily discarded and thanks to elastic fingers 44, the empty refill 10 is held by the cap. The user simply removes the refill and inserts a new refill into body 20, and places the cap onto bottle 10. The cap can easily penetrate up to its attaching position because hook 48, when it arrives at hook 24, is pushed aside and becomes elastic under the latter. Indeed, when the cap has been separated from the envelope body, the force exerted by integrated hinge 52 has made the activation ring 34 turn sufficiently so that the latter permits lever 46 to pivot. Once this attachment is achieved, the user simply brings the activation ring back to the locking position by clockwise rotation of 20 to 30 degrees.

A preferred mode of embodiment has been described that has a certain number of improvements. However, all of them do not have the same importance. For instance, as already indicated, the ledge or projection is only a possible improvement, because lever 46 can operate with an integrated hinge situated at a location of the height of the skirt without ledge or projection.

Likewise, use of a second locking finger is only a possibility. Indeed, the operation of lever 46 is usually prevented because it is fully enclosed between the external cap and the refill.

Likewise, blocking of the activation ring 34 in its rest position can be achieved in any other way, for instance by a simple rubbing of the ring with respect to the rest of the cap, so that the ring can only be operated when necessary.

Since the mechanism is essentially made up by internal cap 33 and the base of activation ring 34, all types of esthetic results can be achieved by simple embodiment of container body 20 and of external cap 32.

The invention claimed is:

1. A refill bottle, comprising a refill and a container, the container comprising a body and a cap that engage through an attachment device wherein:

the cap comprises an external cap with an enclosing or wrap-around skirt, an internal cap equipped with a locking mechanism, and a movable activation ring around a spout of the refill, the attachment device includes at least a fixed hook on the body and a pivoting hook on the internal cap, with the pivoting hook arranged on a lever that pivots around a hinge formed on the internal cap, and the activation ring acts on a first end of the lever opposite to a second end having the pivoting hook.

2. A refill bottle according to claim 1, wherein the hinge comprises an integrated hinge formed by molding.

3. A refill bottle according to claim 1, comprising two attachment devices having opposite positions.

4. A refill bottle according to claim 1, wherein the internal cap comprises at least a projection or ledge in a plane perpendicular to a centerline of the spout, and the hinge is formed onto the projection or ledge and has a radial dimension greater than a thickness of the internal cap.

5. A refill bottle according to claim 1, wherein the activation ring has a rest position in which the attachment device is engaged, and an activation position in which the fixed hook and the pivoting hook are separated.

6. A refill bottle according to claim 1, wherein the activation ring comprises a base and a first radial finger that extends beyond the base for moving the first end of the lever to an unlocking position.

7. A refill bottle according to claim 6, wherein the activation ring includes a second radial finger that extends beyond the base for maintaining the first end of the lever in a locking position so that the fixed and pivoting hooks cannot be separated.

8. A refill bottle according to claim 5, wherein the activation ring includes a blocking protrusion positioned in a cavity of the internal cap when the activation ring is in the rest position.

9. A refill bottle according to claim 8, wherein the cavity of the internal cap is delimited by an elastic component that can flex to let the blocking protrusion pass when subjected to a moving force by rotation of the activation ring.

10. A refill bottle according to claim 1, wherein the external cap, internal cap, and movable activation ring are arranged in an engaged position preventing separation of the internal cap and the external cap.

* * * * *